US009881558B2

(12) United States Patent
Lee et al.

(10) Patent No.: US 9,881,558 B2
(45) Date of Patent: Jan. 30, 2018

(54) DISPLAY DEVICE INCLUDING DATA SCALER AND METHOD FOR DRIVING THE SAME

(71) Applicant: SAMSUNG DISPLAY CO., LTD., Yongin-si, Gyeonggi-do (KR)

(72) Inventors: Jae-Hoon Lee, Seoul (KR); Baek-Woon Lee, Yongin-si (KR); Jung-Taek Kim, Seoul (KR); Jae-Woo Song, Anyang-si (KR); Hae-Goo Jung, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 277 days.

(21) Appl. No.: 14/542,530

(22) Filed: Nov. 14, 2014

(65) Prior Publication Data

US 2015/0310808 A1 Oct. 29, 2015

(30) Foreign Application Priority Data

Apr. 28, 2014 (KR) ..... 10-2014-0050629

(51) Int. Cl.
*G09G 3/36* (2006.01)
*G09G 3/3291* (2016.01)
(Continued)

(52) U.S. Cl.
CPC ..... *G09G 3/3291* (2013.01); *G09G 3/20* (2013.01); *G09G 3/2003* (2013.01);
(Continued)

(58) Field of Classification Search
CPC .. G09G 3/3291; G09G 3/2022; G09G 3/2003; G09G 2320/0223;
(Continued)

(56) References Cited

U.S. PATENT DOCUMENTS 7,154,456 B1 * 12/2006 Saito ..... G09G 3/3216 345/77
7,796,143 B2 * 9/2010 Huang ..... G09G 3/3208 345/102
(Continued)

FOREIGN PATENT DOCUMENTS

EP 1164562 A2 12/2001
EP 1 276 094 A1 1/2003
(Continued)

OTHER PUBLICATIONS

EPO Search Report dated Jul. 21, 2015, for corresponding European Patent application 15151766.1, (14 pages).
(Continued)

*Primary Examiner* — Pegeman Karimi
(74) *Attorney, Agent, or Firm* — Lewis Roca Rothgerber Christie LLP

(57) ABSTRACT

A display device includes a display panel including a plurality of pixels, a control unit configured to scale image data provided from the outside based on an image load factor and to output the scaled image data, and a data driver configured to supply data signals corresponding to the scaled image data to a plurality of data lines connected to the pixels, wherein the control unit includes a load factor calculating unit configured to calculate a load factor of the image data; and a data scaler configured to scale a gray level of the image data based on a scaling ratio corresponding to a load factor.

20 Claims, 12 Drawing Sheets

(51) Int. Cl.
*G09G 3/20* (2006.01)
*G09G 3/3225* (2016.01)

(52) U.S. Cl.
CPC ..... *G09G 3/2007* (2013.01); *G09G 3/3225* (2013.01); *G09G 3/2022* (2013.01); *G09G 2320/0223* (2013.01); *G09G 2320/0233* (2013.01); *G09G 2320/0242* (2013.01); *G09G 2320/0271* (2013.01); *G09G 2320/0626* (2013.01); *G09G 2330/028* (2013.01)

(58) Field of Classification Search
CPC ... G09G 2320/0233; G09G 2320/0242; G09G 2320/0271; G09G 2320/0626; G09G 3/36; G09G 3/30; G09G 3/32
See application file for complete search history.

(56) References Cited

U.S. PATENT DOCUMENTS

2007/0182672 A1 8/2007 Hoppenbrouwers et al.
2008/0174523 A1* 7/2008 Kim ..... G09G 3/294 345/63
2008/0291135 A1* 11/2008 Kim ..... G09G 3/2022 345/76
2009/0040146 A1* 2/2009 Takeuchi ..... G09G 3/296 345/63
2010/0007587 A1 1/2010 Miller
2010/0053137 A1 3/2010 Park et al.
2013/0050292 A1 2/2013 Mizukoshi
2014/0104305 A1* 4/2014 Ryu ..... G09G 3/3208 345/601

FOREIGN PATENT DOCUMENTS

EP 2 722 842 A1 4/2014
KR 10-2010-0046458 A 5/2010
KR 10-2011-0123952 A 11/2011
KR 10-2012-0111675 A 10/2012

OTHER PUBLICATIONS

EPO Search Report dated May 11, 2015, for corresponding European Patent application 15151766.1, (7 pages).
EPO Office Action dated Sep. 26, 2016 for corresponding European Patent Application No. 15151766.1 (12 pages).

* cited by examiner

DISPLAY DEVICE INCLUDING DATA SCALER AND METHOD FOR DRIVING THE SAME

CROSS-REFERENCE TO RELATED APPLICATION

This application claims priority to and the benefit of Korean Patent Application No. 10-2014-0050629, filed on Apr. 28, 2014, with the Korean Intellectual Property Office, the disclosure of which is incorporated herein in its entirety by reference.

BACKGROUND

1. Field

Aspects of embodiments of the present invention relate to a method of driving image data capable of improving (e.g., reducing) luminance deviation and chromatic deviation caused by a voltage drop depending on arrangement position of pixels and to a display device driven by the method of driving image data.

2. Description of the Related Art

In general, a display device includes a plurality of pixels in an area defined by a black matrix and/or a pixel defining layer. The types of display devices may be categorized into a liquid crystal display (LCD), a plasma display panel (PDP), an organic light emitting diode (OLED) display, and the like.

Examples of methods for driving the display device include a sequential driving method of receiving data signals in response to scan signals sequentially applied to the plurality of pixels and emitting lights from the pixels in order of data signal arrival, and a digital driving method of receiving the data signals for one frame and emitting light from all the pixels concurrently (e.g., simultaneously).

In addition, the display device includes a data driver configured to supply data signals to each of the plurality of pixels. The recent trends toward large-sized and high-resolution display devices require more pixels, and power lines applying power to each pixel are therefore reduced in width and increased in length, thereby increasing the resistances of the power lines. A voltage drop caused by the increased resistance produces a voltage deviation of a driving power between pixels adjacent to (or near) the power lines and pixels spaced apart (or far) from the power lines. This voltage deviation leads to non-uniform luminance of pixels depending on the distance of the pixels from the power lines.

The plurality of pixels provided in the OLED display may display one of a plurality of colors including red, green, and blue. The respective pixels include light-emitting materials having different characteristics so as to realize different colors, where driving current values may differ in accordance with the various colors. Further, the voltage deviation of the driving power produced due to the voltage drop along the power line may vary depending on the respective pixels for emitting light having different colors. As a result, luminance and chromaticity may vary depending on the distance of the respective pixels from the power lines.

The magnitude of the voltage deviation of the driving power may be produced based on the color and the position of the pixels in the display device, thereby causing non-uniformity of luminance and chromaticity.

It is to be understood that this background of the technology section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY

Embodiments of the present invention are directed to a large-sized high-resolution display device having improved uniformity of luminance and chromaticity by performing scaling based on scaling ratios that are different depending on the respective colors for displaying input images.

According to an embodiment of the present invention, a display device includes: a display panel including a plurality of pixels; a control unit configured to scale image data provided from the outside based on an image load factor and to output the scaled image data; and a data driver configured to supply data signals corresponding to the scaled image data to a plurality of data lines connected to the pixels, wherein the control unit includes: a load factor calculating unit configured to calculate a load factor of the image data; and a data scaler configured to scale gray level of the image data based on a plurality of scaling ratios corresponding to the load factor, each of the scaling ratios being determined in accordance with a corresponding one of a plurality of colors.

The control unit may further include a subfield assigning unit configured to assign the scaled image data provided from the data scaler to subfields and to supply the subfield data to the data driver.

The data scaler may include a red data scaler, a green data scaler, and a blue data scaler.

At least one of the scaling ratios corresponding to one of the colors may have a lower value compared to the scaling ratios corresponding to the other colors.

At least one of the scaling ratios may be less than 1.

A blue scaling ratio may be the lowest of the scaling ratios.

The display device may further include a power unit configured to generate a driving power for supplying power to the pixels to emit light and to change a voltage value of the driving power supplied to the pixels in accordance with the colors of the corresponding pixels based on the scaled data.

The power unit may be configured to increase the voltage value of the driving power when the scaling ratio is less than 1.

The power unit may be configured to increase the voltage value of the driving power in accordance with a decrease in the scaling ratio.

The subfield assigning unit may be configured to divide a frame into a plurality of subfields having different emission periods.

The subfields may include scan periods.

According to an another embodiment of the present invention, a display device may include: an organic light emitting display panel including a plurality of pixels, the plurality of pixels including a first pixel, a second pixel, and a third pixel configured to emit light having a plurality of different colors, and a plurality of data lines and a plurality of scan lines connected to the plurality of pixels; a scan driver configured to sequentially supply a plurality of scan signals to the scan lines during respective scan periods of the plurality of subfields of one frame; a load factor calculating unit configured to calculate a plurality of load factors of image data provided from the outside; first, second, and third data scalers configured to scale data values of the image data in accordance with scaling ratios of first, second, and third colors of the different colors, the scaling ratios corresponding to the load factors; a data driver configured to supply data signals generated based on the scaled image data to the data lines; and a power unit configured to generate a first driving power, a second driving power, and a third driving power supplied to corresponding ones of the first pixel, the second pixel, and the third pixel and to adjust at least one of voltage values of the first driving power, the second driving power, and the third driving power.

The display device may further include a subfield assigning unit configured to assign the scaled image data provided from the first, second, and third data scalers as subfield data to subfields and to supply the subfield data to the data driver.

At least one of the scaling ratios of the first, second, and third colors may have a lower value than the scaling ratios of the other colors.

The power unit may be configured to increase the voltage values of the driving power in accordance with decreases in the scaling ratios.

The first pixel may be a red pixel, the second pixel may be a green pixel, and the third pixel may be a blue pixel.

According to an embodiment of the present invention, a method of driving a display device may include: calculating a load factor of image data provided from the outside; determining a plurality of scaling ratios corresponding to the load factor, each of the scaling ratios being determined in accordance with a corresponding one of a plurality of colors; scaling a plurality of data values of the image data in accordance with the scaling ratios; adjusting a plurality of voltage values of a driving power corresponding to each of the colors based on the scaling ratios corresponding to each of the colors; and expressing, by the pixels, gray level corresponding to the scaled image data, the scaled image data being scaled in accordance with the colors of the pixels.

At least one of the scaling ratios may have a lower value than the other scaling ratios.

The adjusting voltage values may include increasing the voltage value of the driving power in accordance with a decrease of the scaling ratio.

A blue scaling ratio may be the lowest of the plurality of scaling ratios.

According to embodiments of the present invention, values of the image data provided from the outside are scaled based on the scaling ratios that are differently determined depending on the respective pixel groups classified depending on colors. Further, voltage values of the driving power are adjusted according to the scaling ratios, such that the uniformity of luminance and chromaticity of the display panel can be improved.

The foregoing is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The above and other features and aspects of embodiments of the present invention will be more clearly understood from the following detailed description taken in conjunction with the accompanying drawings, in which.

DETAILED DESCRIPTION

Figure 1:
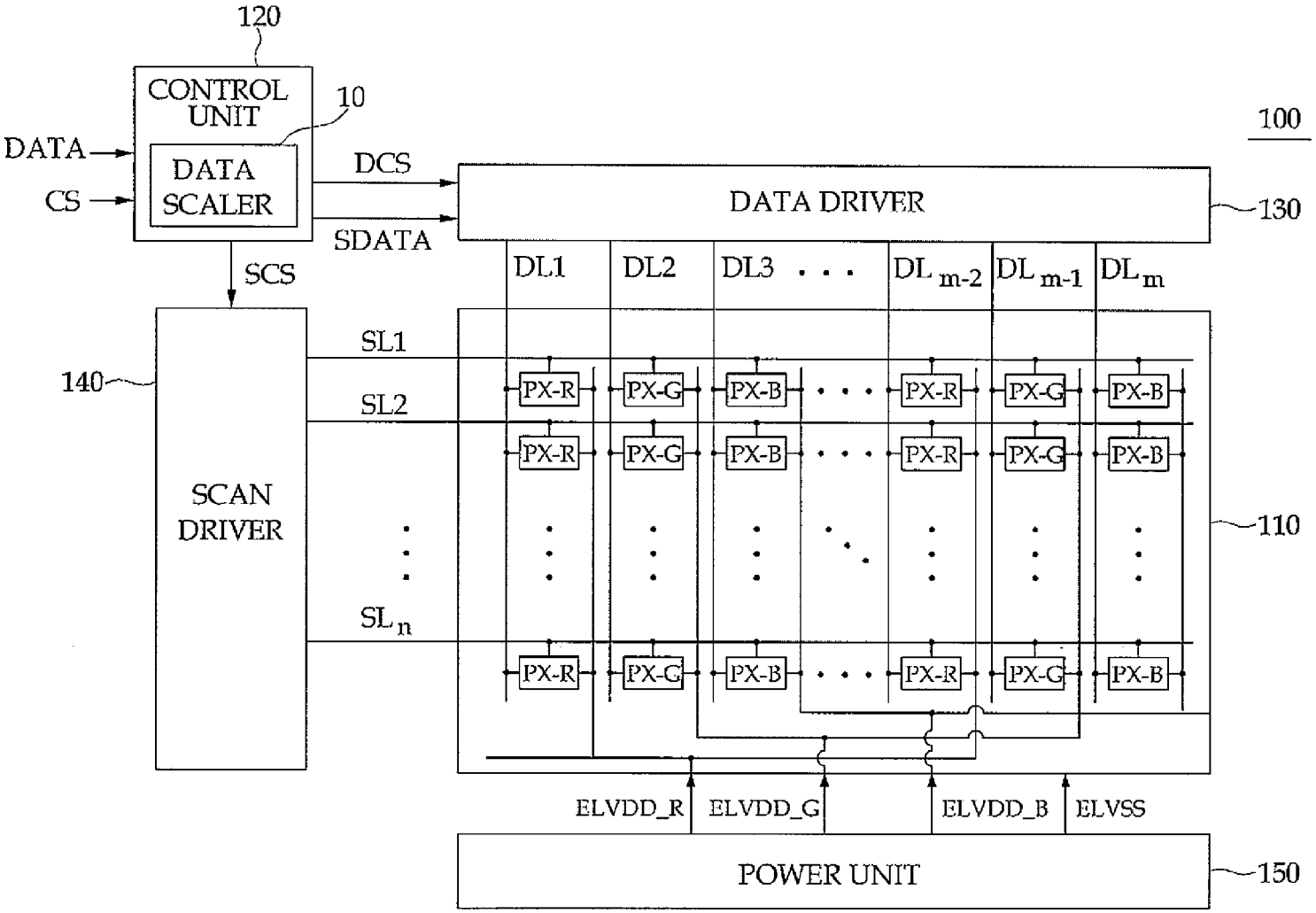
FIG. 1 is a schematic plan view showing a display device according to an embodiment of the present invention.

Hereinafter, embodiments of the present invention will be described in more detail with reference to the accompanying drawings.

Although embodiments of the present invention can be modified in various manners and can have several embodiments, specific embodiments are illustrated in the accompanying drawings and will be mainly described in the specification. However, the scope of the embodiments of the present invention is not limited to the specific embodiments described and should be construed as encompassing all the changes, equivalents, and substitutions that are within in the spirit and scope of the present invention.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" can be termed likewise without departing from the teachings herein.

Some of the parts which are not closely associated with embodiments of the present invention may not be described in order to specifically describe embodiments of the present invention. Like reference numerals refer to like elements throughout the specification.

Hereinafter, aspects and effects of the present invention will be described in more detail with reference to embodiments of the present invention illustrated in the accompanying drawings.

FIG. 1 is a schematic plan view showing a display device according to an embodiment of the present invention.

Referring to FIG. 1, an OLED display 100 includes a display panel 110 including a plurality of pixels including pixel circuits, a data driver 130 configured to apply data signals to the pixel circuits of the pixels over data lines, a scan driver 140 configured to apply scan signals to the pixel circuits, a power unit 150 configured to apply a driving power to the pixel circuits and the OLEDs of the pixels, and a control unit 120 configured to control the data driver 130, the scan driver 140, and the power unit 150.

In addition, the display device 100 may further include a data scaler 10 configured to scale data values of the input image data DATA and the power unit 150 configured to provide a driving power ELVDD and a ground power ELVSS to the display panel 110.

The display panel 110 includes a plurality of scan lines SL1~SLn extending in a row direction for applying scan signals, a plurality of data lines DL1~DLm extending in a column direction, and a plurality of pixels PX arranged in a matrix form and connected to the scan lines SL1~SLn and the data lines DL1~DLm. The driving power ELVDD and the ground power ELVSS are supplied to the plurality of pixels PX from the power unit 150, and further the scan signals and the data signals are supplied to the pixels PX over the scan lines SL1~SLn and the data lines DL1~DLm, respectively, such that the pixels can be driven.

FIG. 1 illustrates the driving power ELVDD separately supplied to the respective pixel groups configured to display colors of red, green, and blue (e.g., driving powers ELVDD_R, ELVDD_G, and ELVDD_B). However, in a case where pixels for displaying colors have the same characteristics, the same voltage may be supplied to two or more pixel groups. Hereinafter, for ease of description, it is assumed that the plurality of pixels PX display one of red, green, and blue colors which are the three primary colors of light.

The display panel 110 can be driven by a digital driving method. The digital driving method is a driving method where an emitting time of the respective pixels PX is adjusted in accordance with the data signal, thereby expressing various gray levels (or gray scale levels). The pixels PX emit light by controlling the supplied driving power ELVDD and ground power ELVSS and the emitting time is adjusted in accordance with the data signal, such that light having a gray level (or gray-scale level) can be expressed. In this case, although the same gray level (or gray-scale level) is displayed (e.g., although the same data signals may be supplied to two different pixels), luminance may vary depending on a voltage value of the driving power ELVDD and ground power ELVSS supplied to the pixels PX.

The display panel 110 may be an organic light emitting panel driven by the supplied driving power ELVDD and ground power ELVSS. The respective pixels PX provided in the organic light emitting panel include OLEDs. In a case where the driving power ELVDD and ground power ELVSS are supplied, current flows through the OLED, such that light is emitted. However, embodiments of the present invention are not limited thereto. Thus, the display panel 110 may be other types of panels including a self-light-emitting element.

The control unit 120 controls the data driver 130, the scan driver 140, and the power unit 150. The control unit 120 is configured to generate signals for controlling the data driver 130, the scan driver 140, and the power unit 150 based on image data DATA and control signals CS provided from the outside (e.g., an external source) and to transmit the generated signals to the data driver 130, the scan driver 140, and the power unit 150. For example, the control signals CS may be timing signals such as vertical synchronization signals Vsync and horizontal synchronization signals Hsync, clock signals CLK, data enable signals DE, and the like, while the image data DATA may be digital signals for expressing a gray level (or gray-scale level) of light emitted from the pixels PX.

The data driver 130 is configured to receive data control signals DCS and the scaled image data SDATA from the control unit 120 and to supply data signals corresponding to the scaled image data SDATA to the pixels PX over the data lines DL1 to DLm in response to (or in accordance with) the data control signals DCS.

The scan driver 140 is configured to receive scan control signals SCS from the control unit 120 and to generate scan signals. Further, the scan driver 140 may transmit the generated scan signals to the pixels PX over the scan lines SL1 to SLn. The pixels PX are sequentially selected on a row-by-row basis in response to the scan signals, such that the data signals can be provided thereto.

The power unit 150 is configured to generate the driving power ELVDD and the ground power ELVSS and to apply the power to the display panel 110. The driving power ELVDD and the ground power ELVSS are applied to the plurality of pixels PX of the display panel 110, such that the pixels PX can emit light. An amount of current flowing through the pixels PX when light is emitted may be determined depending on (or based on) a voltage value (or values) of the driving power ELVDD and the ground power ELVSS (e.g., a voltage difference between the driving power ELVDD and the ground power ELVSS). When pixels PX emit light, if the current that flows through the pixels PX, namely the driving current, is changed, the luminance may be changed even though the same gray level (or gray-scale level) is displayed (e.g., even if the same gray level signals are supplied to the pixels).

Meanwhile, the display panel 100 according to an embodiment of the present invention may include a data scaler 10. In FIG. 1, the data scaler 10 is depicted as being included in (or a component of) the control unit 120; however, embodiments of the present invention are not limited thereto. Thus, the scaler 10 may be provided separately from the control unit 120.

When the digital driving method is used for the OLED display, the control unit 120 includes the data scaler 10 and is configured to divide input image data DATA into subfield data SDATA including on-off information and to provide the subfield data SDATA to corresponding pixels via the data driver 130 in synchronization with a timing of the scan signal. All pixels of the panel perform a data-writing process as many times as the number of subfields (or subframes) of one frame, such that an on-off operation can be performed for the respective subfields.

The data scaler 10 is configured to perform scaling of the image data DATA based on the scaling ratio (which may be predetermined or provided from the outside or an external source, as described in more detail below) and to output the scaled data.

In this case, the power unit 150 may adjust a voltage value of the driving power ELVDD in accordance with the data scaling. In a case where the scaling ratio is, for example, less than 1, the power unit 150 may increase the voltage value of the driving power ELVDD. Accordingly, in a case where the image data scaled by the data scaler 10 has a lower gray level (or gray-scale level) compared to the image data DATA, a voltage value of the driving power ELVDD is increased, such that luminance of light corresponding to the scaled image data can be substantially the same as luminance of light corresponding to the image data DATA.

Figure 2:
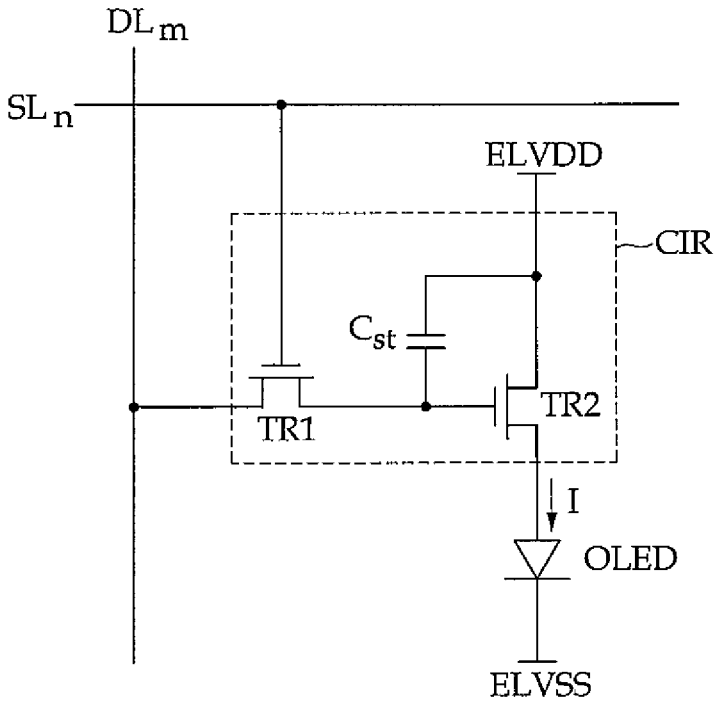
FIG. 2 is a circuit diagram showing a pixel circuit of the display device according to an embodiment of the present invention.

FIG. 2 is a circuit diagram showing a pixel circuit of a display device according to an embodiment of the present invention. In more detail, FIG. 2 illustrates a pixel circuit of an OLED display. For ease of description, a pixel circuit connected to the m th data line DLm and the nth scan line SLn is illustrated.

Referring to FIG. 2, the pixels PX may include the OLED and the pixel circuit CIR configured to supply current to the OLED. Meanwhile, the pixel circuit CIR may include a plurality of transistors TR1 and TR2 and a capacitor Cst. The transistors TR1 and TR2 may be thin film transistors TFTs. In FIG. 2, the pixel circuit CIR is depicted as having two transistors TR1 and TR2 and one capacitor Cst. However, embodiments of the present invention are not limited thereto. Thus, the pixel circuit CIR may have various configurations to supply current to the OLED in accordance with the data signals.

An anode electrode of the OLED is connected to the pixel circuit CIR and a cathode electrode is connected to the ground power ELVSS. Such OLEDs generate light corresponding to the current supplied from the pixel circuit CIR.

When the scan signal is applied to the scan line SLn, the pixel circuit CIR is supplied with the data signal from the data line DLm. In a case where the scan signal is supplied to the scan line SLn, the first transistor TR1 is turned on and the data signal is applied to a gate electrode of the second transistor TR2 over the data line DLm. In this case, the data signal controls turn-on/turn-off of the second transistor TR2. Further, in a case where the second transistor TR2 is turned on in response to the data signal, the driving power ELVDD is applied to the anode electrode of the OLED, such that current I flows through the OLED. Accordingly, the OLED emits light. In this case, an amount of the current I may vary depending on the voltage applied to both end portions of the OLED (or across the OLED), in other words, depending on voltage values of the driving power ELVDD and the ground power ELVSS. In a case where the second transistor TR2 is turned off, the anode electrode of the OLED floats, such that light becomes extinguished in (or light is not emitted from) the OLED. The capacitor Cst stores a voltage corresponding to the voltage difference between the driving power ELVDD and the applied data signal, such that the second transistor TR2 can maintain a turned-on or turned-off state while the first transistor TR1 is turned off and the data signals are not applied to the second transistor.

Luminance of the light emitted from the pixels PX is determined by an emitting time (or emitting duration) of the pixel PX and a current value of the current I which flows when light is emitted. Luminance of the light emitted from the pixel PX is increased either or both as an emitting time of the pixel PX in one frame period increases and as the current value proportional to the voltage value of the driving power ELVDD increases.

Figure 3:
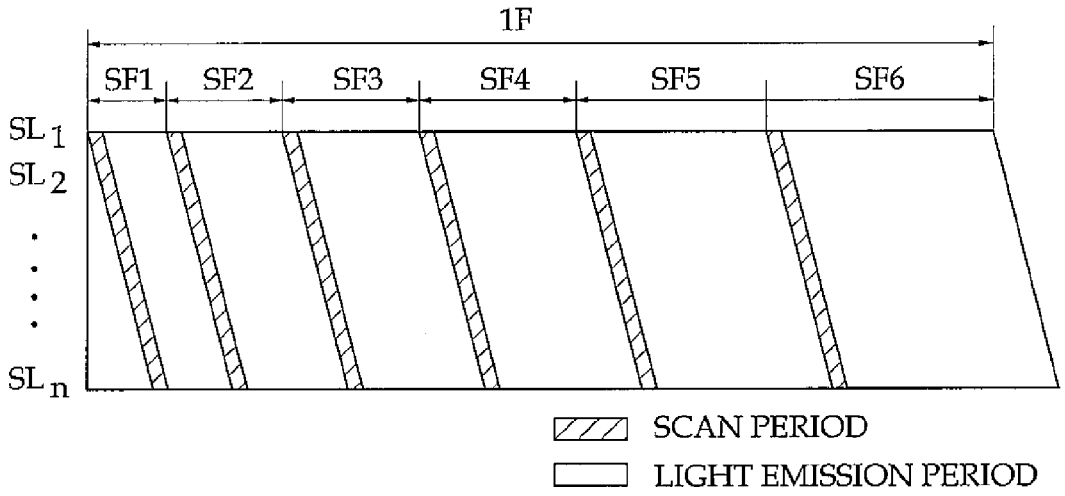
FIG. 3 is a timing diagram illustrating one frame of a digital driving method according to an embodiment of the present invention.

FIG. 3 is a timing diagram illustrating one frame of a digital driving method according to an embodiment of the present invention.

With reference to FIG. 3, one frame 1F may include a plurality of subfields SF1, SF2, SF3, SF4, SF5, and SF6. Each of the plurality of subfields SF1, SF2, SF3, SF4, SF5, and SF6 may be divided into a scan period and an emission period.

The scan signals are sequentially supplied to the scan lines SL1 to SLn during a scan period.

During one frame, each of the scan lines is supplied with a number of scan signals, which is the same as the number of subfields (or the number of scan periods), in other words, one scan signal per subfield.

In a case where the scan signal is sequentially supplied to the scan lines during a scan period of one subfield, the pixels PX are selected on a row-by-row basis. In this case, the data signals are provided to the pixels PX selected according to the scan signals.

During an emission period, the pixels PX emit or do not emit light according to the subfield data SDATA supplied during the scan period. During an emission period, a voltage value of the data is, for example, 5V when light is emitted and 0V when light is not emitted. During the emission period, time lengths of the respective subfields SF1, SF2, SF3, SF4, SF5, and SF6 are differently determined by intervals between scanning signals, namely, the scan periods. Accordingly, the time lengths of the emission periods of the subfields SF1, SF2, SF3, SF4, SF5, and SF6 are adjusted, such that binary weights of the corresponding subfields can be determined.

The binary weight assignment is a concept similar to the binary representation of decimal numbers. For example, it may be assumed that one frame is divided into six subfields and that a subfield has an emitting time two times longer than the previous subfield. Each of the six subfields represents each digit position of a binary number in order to express luminance. For example, the first subfield SF1 has a binary weight of $2^0$, and the second subfield SF2 has a binary weight of $2^1$, and so forth, such that the binary weights of the respective subfields have a growing sequence of $2^n$ (, where n=0, 1, 2, 3, 4, 5).

As a result, the display device may express $2^6$=64 gray levels of luminance (including a black color) by differently combining on and off states by using the subfield data SDATA. If arranged from the one having a shortest time of the emission period (or having a lowest binary weight), to the one having a longest time of the emission period (or having a largest binary weight), the subfields make an order of SF1, SF2, SF3, SF4, SF5, SF6. For example, the length of an emission period of SF2 is longer than that of SF1, and thus SF2 may thereby correspond to a one-digit-position upper bit of a binary number compared to SF1. Accordingly, if arranged corresponding to the bit positions of the binary number, the subfields make an order of SF6, SF5, SF4, SF3, SF2, and SF1.

Thus, the gray level (or gray-scale level) of the pixels can be expressed as follows: an on-state data voltage of a subfield (e.g., 5V) is expressed as (or corresponds to) '1' in binary form, whereas an off-state data voltage of a subfield (e.g., 0V) is expressed as (or corresponds to) '0' in binary form. For example, a gray level of 63 can be expressed as '111111' in binary form, and thus all subfields in one frame therefore have on states, respectively, exhibiting a state of "SF6, SF5, SF4, SF3, SF2, SF1"="On, On, On, On, On, On." This means that the corresponding pixel is supplied with on-state data for all subfields in the frame and emits light accordingly. Further, a gray level of 6 can be expressed as '000110' in binary form. In this case, the subfields 2 and 3 have on states, exhibiting a state of "SF6, SF5, SF4, SF3, SF2, SF1"="Off, Off, Off, On, On, Off," such that the pixel emits light only during subfields 2 and 3, thereby expressing the gray level of 6. Accordingly, the emitting time of the pixels PX in one frame period are adjusted, such that the gray level (or gray-scale level) can be expressed.

FIG. 3 illustrates an embodiment of the present invention using 6-bit driving where one frame includes 6 subfields;

however, one frame may include various numbers of subfields as well. Further, referring to FIG. 3, an embodiment of the present invention illustrates that the subfields are, for example, arranged in an ascending order of the binary weights; however, subfields may be arranged in a descending order or regardless of the binary weights in one frame. Further, different forms of digital driving methods other than the above description may also be applied.

Figure 4:
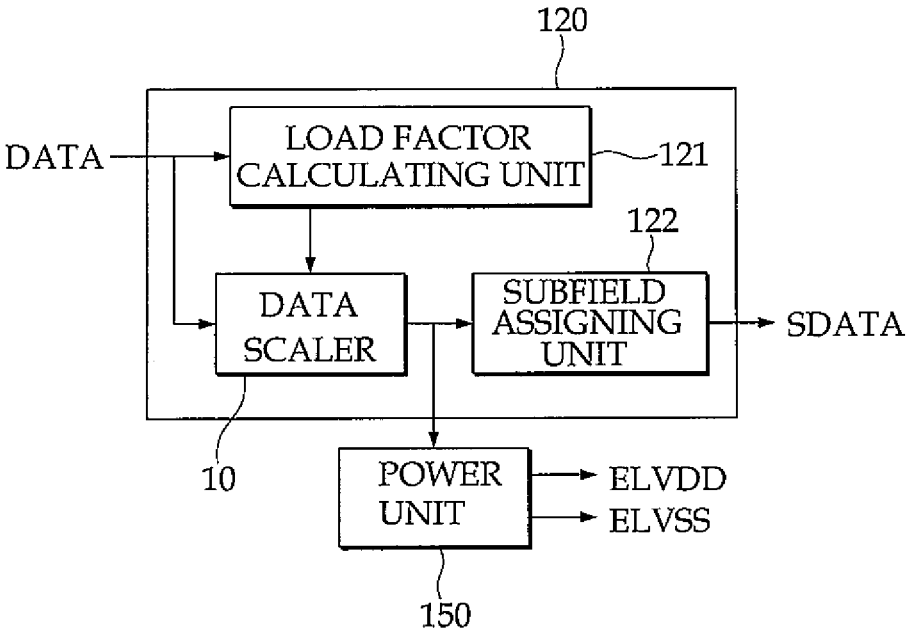
FIG. 4 is a schematic block diagram illustrating a control unit of the display device according to an embodiment of the present invention.

FIG. 4 is a schematic block diagram illustrating a control unit of the display device according to an embodiment of the present invention.

The control unit 120 may include a load factor calculating unit 121 configured to calculate a load factor of the input image data DATA. The load factor calculating unit 121 is supplied with image data and outputs a corresponding load factor to the data scaler 10. The data scaler 10 is supplied with the image data and performs scaling of image data based on a scaling ratio determined according to the load factor.

The load factor of image data is a percentage ratio of a total sum of the image data values to a maximum image information value of one frame. For example, color image information having resolution of 1920×1080 includes all of three color image information, and thus one frame therefore contains image gray level (or gray-scale level) information of 1920×1080×3=6,220,800 pixels. On condition that the respective pixels can express 255 gray levels, the maximum load value of the image information becomes:

$$1920\times1080\times3\times255=1,586,304,000.$$

In this case, the maximum load value refers to an image data value having a 100% load factor when all the pixels of the display panel display a full white color image with the maximum gray level (or gray-scale level). Further, the load factor refers to a ratio of a load value corresponding to the image data value to a 100% load value in percentage terms.

In a case where all the pixels emit light having a 100% load factor, the maximum current value for emitting light flows through the power lines and a voltage drop across the driving power ELVDD therefore becomes the largest. On the other hand, in a case where all the pixels are not supplied with image signals and thus have a 0% load factor, current for emitting light does not flow, such that a voltage drop across the driving power ELVDD is not produced. In the foregoing description, an embodiment of the present invention illustrates that, for example, all the gray level (or gray-scale level) values are added in order to describe a concept of a load factor. However, embodiments of the present invention are not limited thereto, and thus the load factor may be determined by other methods such as adding only the most significant bits in order to make the best use of an arithmetic processor.

A subfield assigning unit 122 is configured to receive the scaled image data, to produce subfield data SDATA including on-off information of the pixels, and to provide the produced data to the data driver 130.

In other words, when a digital driving method where an emitting time is adjusted is used, the data scaler 10 changes the gray level value of the image data to a lower or a higher gray level value and the subfield assigning unit 122 outputs the subfield data including on-off signals applied to the respective pixels based on the changed gray values. The control unit 120 may provide information about the data scaling ratio to the power unit 150. Further, the power unit 150 may adjust a voltage value of the driving power ELVDD according to the provided data scaling ratio.

For example, although the data scaler 10 performs downscaling of the input image data and thereby produces a data signal having a gray level less (or smaller) than a previous gray level, a voltage value of the driving power ELVDD is increased, such that the low gray level can be compensated for. Accordingly, the pixels supplied with the subfield data SDATA provided from the subfield assigning unit 122 may display luminance substantially the same as luminance corresponding to the gray level (or gray-scale level) of the input image data DATA supplied to the image load factor calculating unit 121 by generating a large intensity of light with the highly compensated driving power ELVDD, although an emitting time is shortened.

Figure 5:
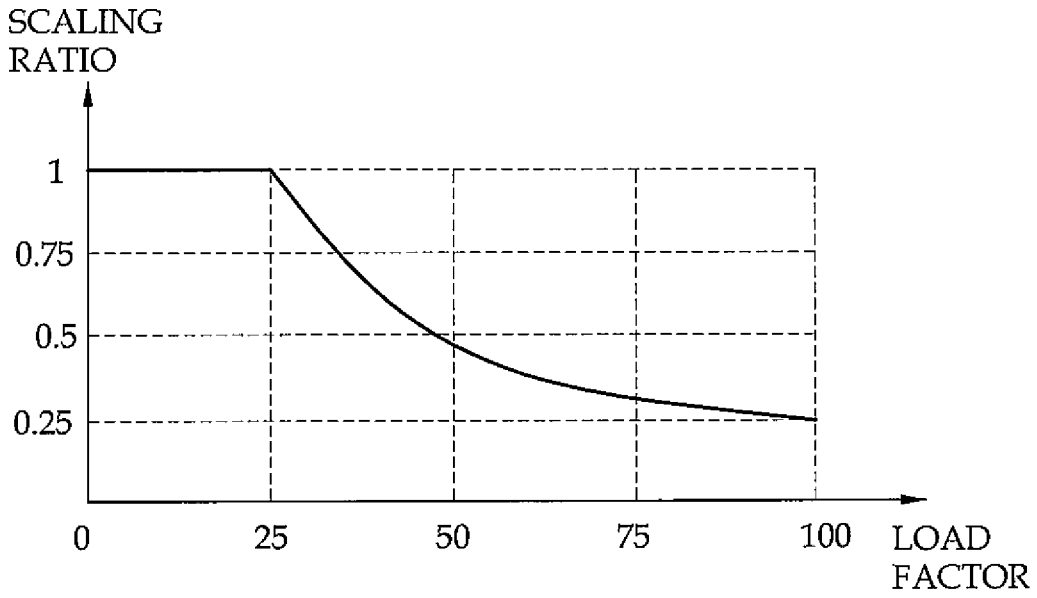
FIG. 5 is a graph illustrating a relationship between an image load factor and a scaling ratio according to an embodiment of the present invention.

FIG. 5 is a graph illustrating a relationship between an image load factor and a scaling ratio according to an embodiment of the present invention. In a case where a load factor is large, a deviation depending on the position of the respective pixels becomes large due to the voltage drop across the driving power ELVDD, and thus a scaling ratio $\alpha$ of the data scaler has a low or minimum value. On the other hand, in a case where a load factor is less than a level (e.g., a predetermined level), deterioration of image quality caused by the voltage drop is usually not noticed, and thus the scaling ratio $\alpha$ of the data scaler may have a high or maximum value. Because the down scaling method is generally performed, in one embodiment the maximum value of the scaling ratio $\alpha$ is 1. A value of the scaling ratio $\alpha$ corresponding to the image load factor is determined in consideration of the characteristics of the panel and other factors and is stored in the control unit 120 of the display device.

With reference to FIG. 5, a scaling ratio $\alpha$ of 1 is used for a load factor of 25% or less. In this case, the scaling ratio $\alpha$ of 1 means that an input image signal is not converted when transmitted to the subfield assigning unit 122. A graph of the scaling ratios in FIG. 5 is described as an example and thus different types of graphs may be used depending on characteristics of the display panel.

For example, it is assumed that, in a case where a value of an 8-bit digital image data DATA applied to the pixels has a gray level of 128 (or '1000 0000' in binary), luminance of light emitted from the pixels PX of the display panel 110 is set to be 75 nit when the driving power ELVDD is 5V. As illustrated in FIG. 5, in a case where a load factor is 50% in a 128-gray-level environment, a scaling ratio $\alpha$ becomes 0.5.

In an example of conditions in which the image data DATA is scaled to have a scaling ratio $\alpha$ of 0.5, the driving method is as follows.

When image data DATA expressing a gray level of 128 is scaled by 0.5 times based on the scaling ratio, a data value of the scaled image data has a gray level of 64 (or '0100 0000 in binary').

In this case, luminance of light outputted before and after the data scaling should be the same. However, when a digital driving method is used, the luminance is determined (or controlled) in accordance with an emitting time and a current value of the driving current. In a case where a gray level of 128 is expressed, an emitting time of the pixel is longer compared to a case where a gray level of 64 is expressed.

Thus, a current value of the driving current having a gray level of 64 should be increased in order to increase an intensity of light compared to a case of a gray level of 128, such that a data signal representing a gray level of 128 before performing scaling and the gray level of 64 after performing the scaling can express substantially the same luminance.

The power unit 150 may increase the driving current by outputting a voltage value of the driving power ELVDD of, for example, 6V, which is higher than 5V. Accordingly, although the scaled image data having a gray level is applied to the pixel PX, luminance of light outputted from the pixel PX becomes substantially the same as 75 nit which corresponds to the image data having a gray level of 128 before performing the scaling.

Because the luminance before and after performing the scaling should be the same, the power unit 150 may increase a voltage value of the driving power ELVDD in accordance with a decrease in the scaling ratio (e.g., the power unit may increase the voltage of the driving power ELVDD more as the scaling ratio decreases).

For example, as illustrated in FIG. 5, in a case where 8-bit digital image data DATA applied to all the pixels has a load factor of 100% when having the maximum gray level of 255 which is '1111 1111,' the scaling ratio $\alpha$ becomes 0.25. Thus, the scaled image data generated by scaling the image data DATA of '1111 1111' by 0.25 times expresses a gray level of 63, which is '0011 1111.' In this case, a voltage value of the driving power ELVDD may be, for example, 7V, which is higher than 6V, when the scaling ratio $\alpha$ is 0.5, such that luminance of output light can be 150 nit, which corresponds to a gray level of 255.

In the above, an embodiment of the present invention illustrates a case where the voltage value of the driving power ELVDD is changed based on the scaling ratio; however, embodiments of the present invention are not limited thereto. For example, in some embodiments, the scaling ratio may be determined based on the voltage value of the driving power ELVDD. In other words, as the power unit 150 increases the voltage value of the driving power ELVDD, the data scaler 10 may accordingly scale the data value of the image data DATA and output the scaled image data. Further, the data scaler 10 may lower the gray level (or gray-scale level) by scaling the data value of the image data DATA, such that luminance of light outputted from the display panel 110 can be the same as the luminance determined based on the voltage value of the driving power ELVDD before converted.

As described above, the display device 100 according to an embodiment of the present invention may be configured to perform scaling of the data value of the image data DATA provided from the outside and accordingly adjust the voltage of the driving power ELVDD outputted from the power unit 150.

Figure 6:
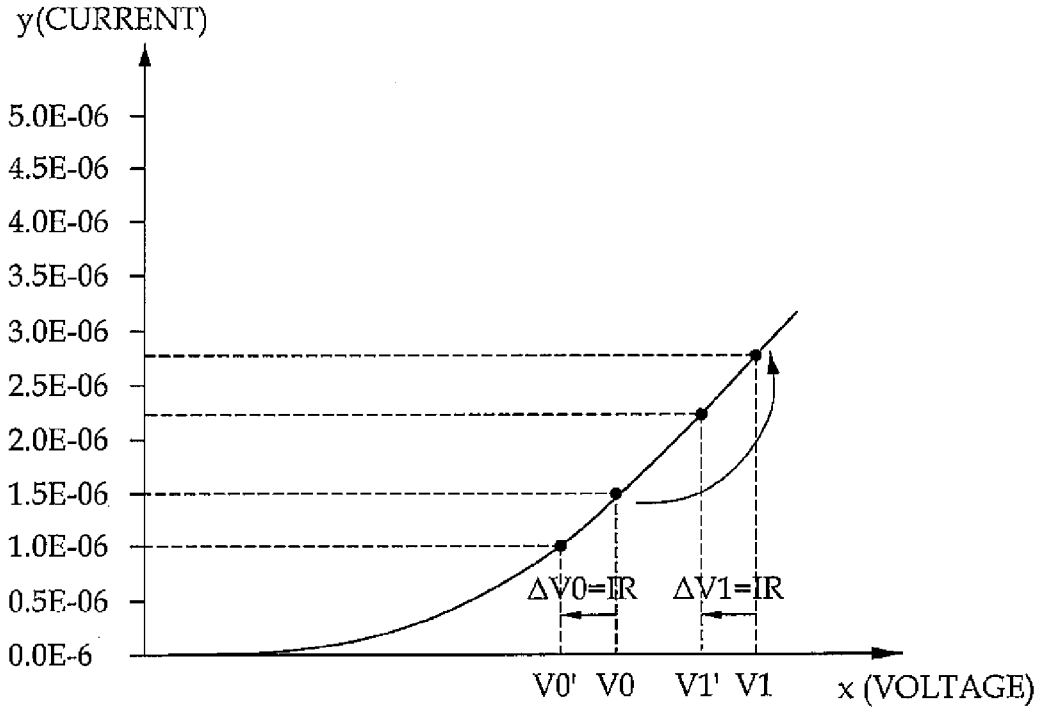
FIG. 6 is a graph illustrating a relationship between a driving voltage and current for improving luminance uniformity of the display device according to an embodiment of the present invention.

FIG. 6 is a graph illustrating a principle of improving luminance uniformity by increasing the driving voltage of the driving power ELVDD. In FIG. 6, x-axis represents a voltage difference between the driving power ELVDD and the ground power ELVSS applied to the pixel PX. For ease of description, it is assumed that the ground power ELVSS is at a voltage of 0V and voltages V0, V0', V1, and V1' of the x-axis represent voltage values of the driving power ELVDD applied to the pixels PX. In this case, V0 is a voltage value of the driving power ELVDD when the display device is driven by a comparative driving method and V1 is a voltage value of the driving power ELVDD when the display device is driven by a data scaling driving method. V0' and V1' represent voltage values of the driving power ELVDD after the voltage drop occurrence, respectively.

In addition, the y-axis represents current flowing when the voltage of the driving power ELVDD is applied to the pixels PX and the pixels PX emit light accordingly, e.g., a current value of the current I flowing through the OLED of FIG. 2. In this case, specific values described herein may vary depending on the characteristics of the display panel such as the characteristics of the OLED. In addition, as illustrated in FIG. 4, a relationship between voltage and current can be approximated to a linear formula when a voltage is larger than a particular value (or a predetermined value), and thus may be assumed to be a linear function and expressed as FORMULA 1:

$$y=f(x)=\beta x, \qquad \text{FORMULA 1}$$

where x represents a voltage value of the driving power ELVDD, y represents a current value of the driving current I flowing through the pixels PX, and $\beta$ represents a slope of the graph.

Further, the luminance is changed depending on an amount of the reduced current value corresponding to an amount of the voltage drop IR, and thus luminance uniformity (LRU: Long Range Uniformity) of the display panel becomes a ratio of the minimum luminance to the maximum luminance, thereby expressed as FORMULA 2:

$$LRU(x)=f(x')/f(x)=f(x-IR)/f(x)=\beta(x-IR)/\beta x=(x-IR)/x, \qquad \text{FORMULA 2}$$

where x represents a voltage value of the driving power ELVDD, x' represents a voltage value of the driving power ELVDD after a voltage drop occurrence, and IR represents an amount of the voltage drop.

In a case where the display panel 110 is driven by the comparative driving method, the driving power ELVDD is V0. Further, in a case where the display panel 110 expresses a full white image having the maximum luminance, a voltage drop is caused across the driving power ELVDD. As a resistance value of the power line connected to the driving power ELVDD is increased, the voltage drop becomes larger.

Accordingly, the voltage of the driving power ELVDD applied to the pixels PX has a deviation and may produce a maximum deviation of $\Delta$V0. Thus, the current I flowing through the OLED has different current values for the respective pixels PX. In this case, luminance may vary depending on current values of the driving current I, and thus when a voltage value of the driving power ELVDD is V0, the luminance uniformity may be expressed as FORMULA 3:

$$LRU(V0)=f(V0')/f(V0)=f(V0-IR)/f(V0)=\beta(V0-IR)/\beta V0=(V0-IR)/V0. \qquad \text{FORMULA 3}$$

Meanwhile, in a case where the display panel 100 is driven by the data scaling method, a voltage value of the driving power ELVDD is increased to V1 in order to increase a current value of the driving current I and further image data is scaled, such that the full white image having substantially the same luminance as before can be displayed. For example, in a case where a voltage value of the driving power ELVDD is V0 and a gray level of 255 is expressed in a comparative driving method, a voltage value of the driving power ELVDD may be increased to V1 and a gray level of 64 may be expressed when the data scaling driving method is used.

Meanwhile, in a case where the voltage value of the driving power ELVDD in increased to V1, a current value of the driving current I may be about two times of the current value of the driving current I when the voltage value of the driving power ELVDD is V0.

In this case, provided that the voltage drop across the driving power ELVDD is caused, the driving power ELVDD applied to the pixels PX exhibits a deviation and may produce a maximum deviation of $\Delta$V1. Luminance is the same as the luminance in the comparative driving method, and thus the average current outputted for one frame of the display period becomes the same as before. Therefore, an amount of the voltage drop IR may be the same as before.

In a case where a voltage value of the driving power ELVDD is increased to V1, luminance uniformity may be expressed as FORMULA 4:

$$LRU(V1)=f(V1')/f(V1)=f(V1-IR)/f(V1)=\beta(V1-IR)/\beta V1=(V1-IR)/V1. \quad \text{FORMULA 4:}$$

Further, V1 is γ*V0 (γ>1), and thus, when substituting V1=γ*V0 into the expression, luminance uniformity finally produces FORMULA 5:

$$LRU(V1)=(\gamma^*V0-IR)/\gamma^*V0=(V0-IR/\gamma)V0. \quad \text{FORMULA 5:}$$

When comparing FORMULA 3 expressing LRU (V0) according to the comparative driving method to FORMULA 5 expressing LRU (V1) according to the data scaling method, because γ is larger than 1, and thus luminance uniformity according to the data scaling driving method is larger than the luminance uniformity according to the comparative driving method. In addition, as γ increases, the luminance uniformity becomes larger.

Thus, when the display device 100 is driven by the data scaling driving method, luminance uniformity may be increased. Meanwhile, as the data scaling ratio α decreases, the voltage value of the driving power ELVDD should be increased, and thus γ may be inversely proportional to the data scaling ratio α. A ratio of inverse proportion between γ and a data scaling ratio α may vary depending on characteristics of the display panels. As examples of factors determining the ratio of inverse proportion, there are types of an organic light emitting material, a material of the data line of the display panel, and a line width. Therefore, if a data scaling ratio is adjusted, the extent of improvement in luminance uniformity can be adjusted accordingly.

Figure 7:
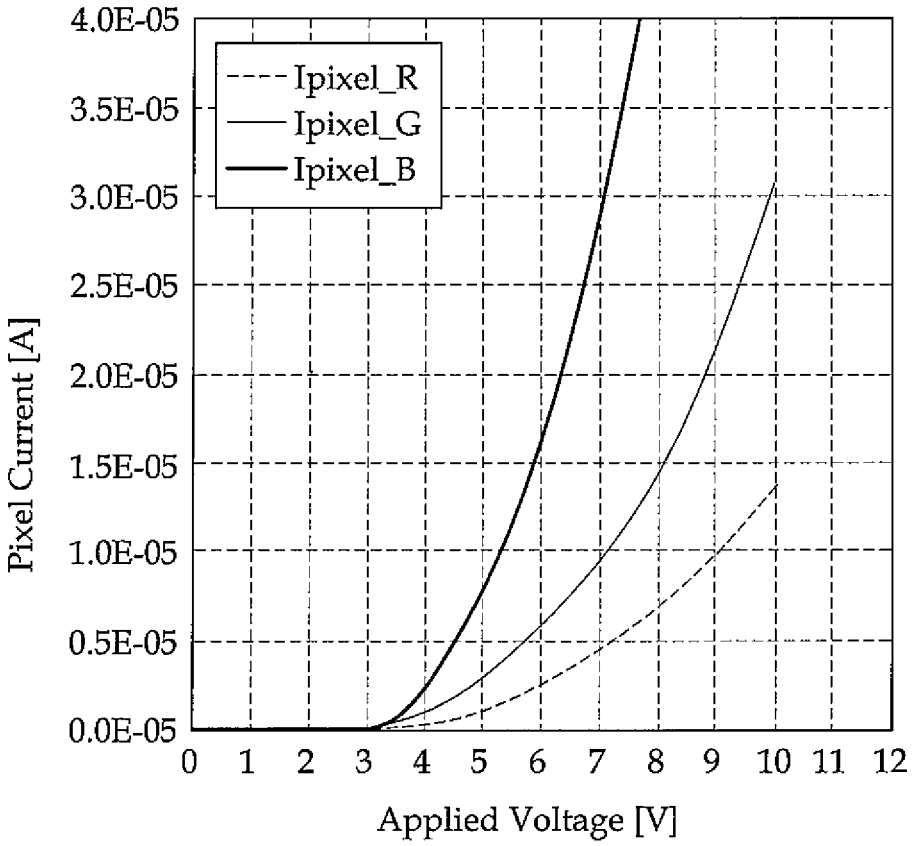
FIG. 7 is a graph illustrating a relationship between a driving voltage and a driving current depending on pixel colors of an OLED.

FIG. 7 is a graph illustrating a relationship between a driving voltage and a driving current depending on pixel colors of an OLED.

Figure 8:
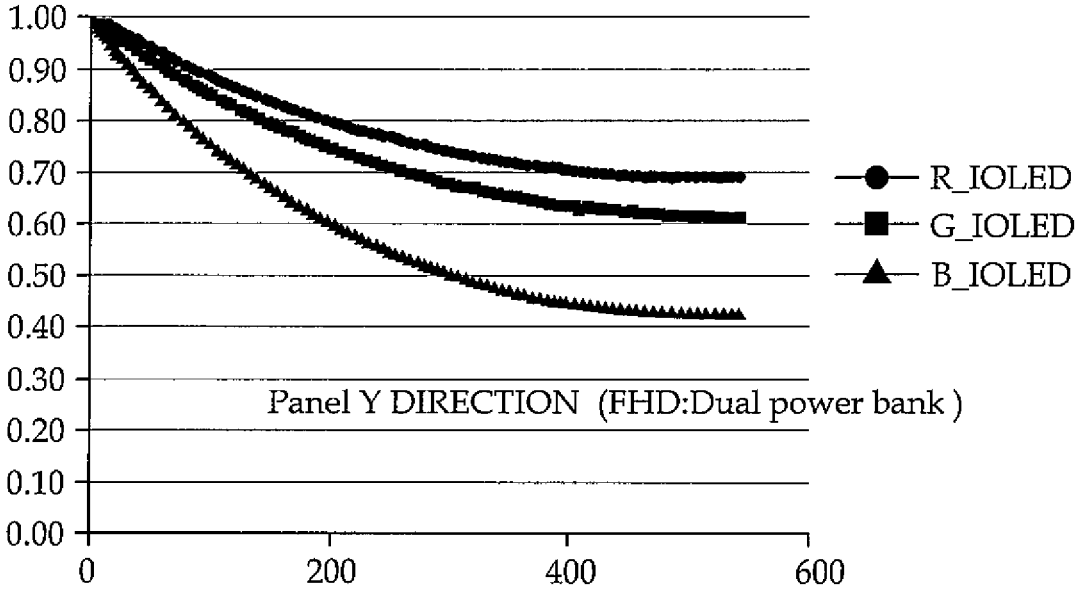
FIG. 8 is a graph illustrating a relationship between standardized current and the position of pixel horizontal lines depending on pixel colors of an OLED.

FIG. 8 is a graph illustrating a relationship between standardized current and pixel horizontal line position depending on pixel colors of an OLED, where the x-axis may represent a distance from the point at which driving power is applied in terms of a number of pixels.

With reference to FIG. 7, a ratio of the driving current to the driving voltage of a light-emitting pixel for displaying a red color Ipixel_R exhibits a gentle (or shallow) slope compared to a ratio of a driving current to a driving voltage of a light-emitting pixel for displaying a blue color Ipixel_B (e.g., having a steeper slope).

In addition, phosphors realizing colors of an organic electroluminescent element have different voltage-current characteristic curves depending on colors of emitted light (e.g., having a different voltage-current characteristic curve for each color of light or for each of the different types of pixels, each type emitting a different color), and thus non-uniform luminance is noticed depending not only on color (e.g., colors of emitted light) but also on position of the pixels.

Accordingly, with reference to FIG. 8, in a case where the display device displays a full white color, a chromatic deviation is produced depending on the distance from the point where the driving power is applied. In other words, in a case where the display device displays a full white color from all the pixels, although the respective pixels having different colors are located in the same position, different standardized current values are applied depending on colors of the pixels. Further, an amount of voltage drop of the pixels depending on colors may vary depending on the position of the pixels.

Therefore, because an amount of the voltage drop varies depending on colors of the pixels, the data scaling ratio α and the voltage value γ*V0 of the driving power ELVDD should be determined differently depending on colors of the pixels or the pixel lines.

The scaling ratio α becomes the smallest in a pixel having a color requiring the largest current and the scaling ratio α becomes relatively large in a pixel having a color requiring the smallest current.

With reference to FIG. 7, when considering characteristics of the organic electroluminescence element, because a driving current of the pixel for displaying a blue color is larger than a driving current of the pixel for displaying a red color, in a case where a pixel is supplied with an image signal having a load factor of, for example, 50%, $\alpha_b$ and $\alpha_r$ are determined to satisfy $\alpha_b>\alpha_r$. In this case, $\alpha_b$ is a scaling ratio of a blue pixel and $\alpha_r$ is a scaling ratio of a red pixel.

Thus, scaling ratios become different depending on colors (e.g., the scaling ratios may be different for each of the colors or for each of the different types of pixels, each type emitting a different color), such that a red image signal and a blue image signal of the input image signals having the same gray level value in the same frame may have different gray level values when outputted. For example, although a red color and a blue color have the same gray level of 64 in a full white color input image (e.g., in input image data DATA), the red color is converted into a gray level of 32 and a blue color is converted into a gray level of 28 when supplied to the pixels (e.g., in scaled image data SDATA).

As described above, red data having an input value of a gray level of 64 is scaled to have a gray level of 32 and thus a red pixel outputs luminance which corresponding to 50% of a target luminance (e.g., the red pixel is driven in accordance with scaled data corresponding to 50% of the input data for that pixel). Further, blue data is reduced to a gray level of 28 and thus the blue pixel outputs luminance which is 43% of a target luminance (e.g., the blue pixel is driven in accordance with scaled data corresponding to 43% of the input data for that pixel).

Meanwhile, the voltages ELVDD_R, ELVDD_G, and ELVDD_B of the driving power applied to the red, green, and blue pixels are increased in consideration of voltage-current characteristic curves in order to compensate differences between the data scaling ratios, such that substantially the same luminance can be outputted. For example, a driving voltage of a red pixel ELVDD_R is increased to 6V from 5V and a driving voltage of a blue pixel ELVDD_B is increased to 6.5V from 5V. Generally, it is desirable that the driving voltage of the blue pixel ELVDD_B is compensated to be larger compared to the driving voltages of the red or green pixels ELVDD_R or ELVDD_G. Accordingly, the deviations of luminance and chromaticity caused by the voltage drop of the driving power of the display panel can be improved (e.g., deviations can be reduced) together.

The embodiment of the present invention illustrates red and blue colors as examples; however, the scaling ratios may be determined differently for each of the colors. Provided that characteristics of the display device depending on colors are similar, the data scalers for individual colors may have the same scaling ratio. Further, in a case where characteristics of the display device are different for different colors, one scaler may treat data having different colors with different scaling ratios.

Figure 9:
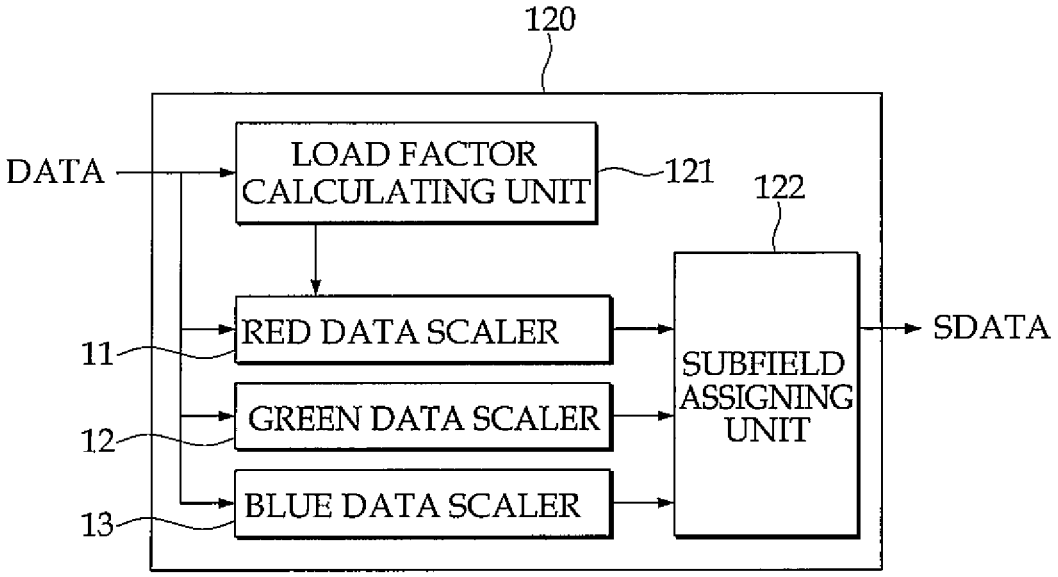
FIG. 9 is a schematic block diagram illustrating a control unit of the display device according to another embodiment of the present invention.

FIG. 9 is a schematic block diagram illustrating a control unit of the display device according to another embodiment of the present invention. A control unit 120 may include a load factor calculating unit 121 configured to calculate load factors of input image data. The load factor calculating unit 121 transmits the calculated load factors to red, green, and blue data scalers 11, 12, and 13, respectively. The data scalers 11, 12, and 13 perform scaling of the image data having different colors with different scaling ratios depending on colors corresponding to the load factors, respectively. In this case, the data scalers 11, 12, and 13 may include a look up table (LUT) where the scaling ratios are differently determined depending on colors (e.g., where different scaling ratios are stored in accordance with different colors).

A subfield assigning unit 122 provides subfield data SDATA including on-off signals applied to the respective pixels based on the converted gray level (or gray-scale level) to the respective pixels over the data lines.

Because the gray level (or gray-scale level) applied to the pixels are different from each other depending on colors (e.g., different from each other on a color-by-color basis), different subfield data SDATA may be used for expressing a gray level (or gray-scale level), although the subfield assigning unit 122 converts the scaled data into the subfield data SDATA having on-off voltages. The scaling ratios are differently applied in accordance with color by a plurality of data scalers, such that output luminance of the image may be reduced compared to the target luminance when the image is outputted (e.g., the gray levels supplied to the pixels may be reduced compared to the gray levels supplied as input).

Figure 10:
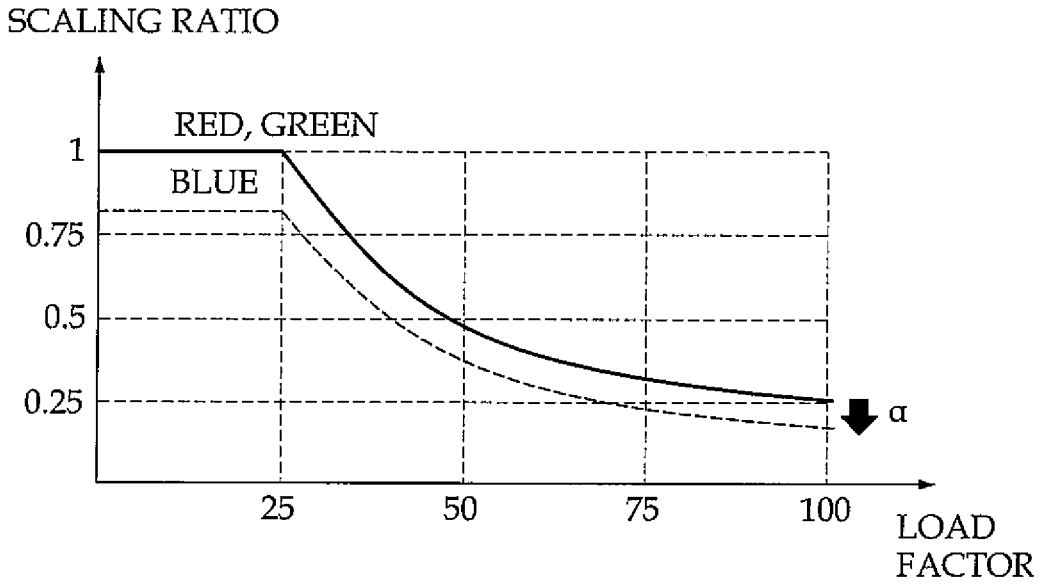
FIG. 10 is a graph illustrating a relationship between a load factor and a data scaling ratio depending on pixel colors of an OLED.

FIG. 10 is a graph illustrating data scaling ratios of the respective colors depending on (or in accordance with) a load factor. In FIG. 10, graphs of only red and blue scaling ratios are illustrated for ease of description; however, the green data can also be scaled with a separate scaling ratio as in FIG. 10.

At least one of the scalers 11, 12, and 13 having different colors has a scaling ratio less than 1, corresponding to the load factor of the input image lower than a reference point.

With reference to FIG. 10, in order to maintain or improve chromatic uniformity, scaling ratios of the data scalers of the pixel having a different color may be determined as: determining a reference color pixel (e.g., a red scaler of FIG. 10); determining scaling ratios of the reference color pixel for all load factors; and then multiplying a color compensation ratio value with a ratio (e.g., a predetermined ratio) based on the reference scaling ratio.

For example, in a case where a scaling graph of a red pixel is determined as a reference scaler, a blue data scaler having a larger current consumption compared to the red scaler is multiplied by a color compensation ratio less than 1 to produce a blue data scaling graph, and the driving power applied to the blue pixel ELVDD_B is adjusted according to the compensated scaling ratio of the blue color. In the above, an embodiment of the present invention illustrates red and blue colors as examples; however a data scaling ratio and a driving voltage of a green color may be adjusted by the same method.

Figure 11:
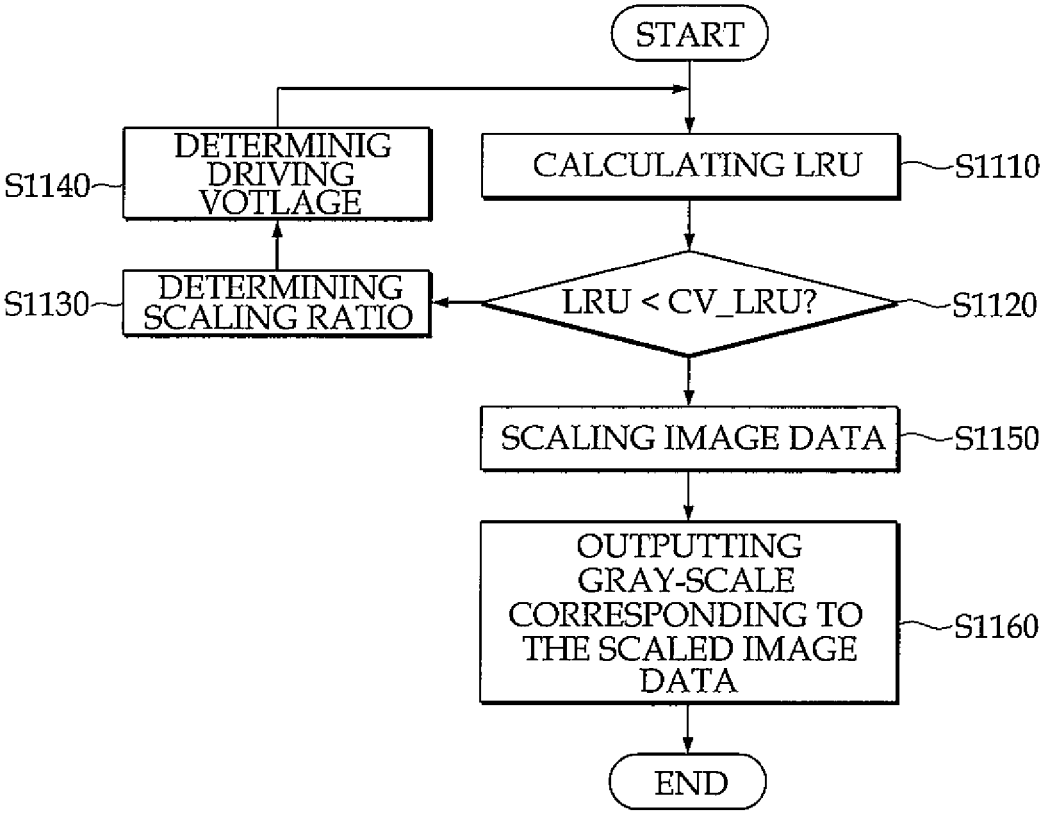
FIG. 11 is a flow chart illustrating a method of driving a display device according to an embodiment of the present invention.

FIG. 11 is a flow chart illustrating a method of driving a display device according to an embodiment of the present invention.

In an initiating process or a test process, a driving condition of the display panel 100 is established so that luminance uniformity of the display panel 110 is higher than a level (e.g., a predetermined level). The display device 100 may be driven by the data scaling method.

Luminance uniformity of the display panel 110 is firstly calculated (S1110). A test image, for example, a full white image having the maximum gray level (or gray-scale level), is displayed on the display panel 110. Thus, luminance uniformity can be calculated based on the luminance data of the respective colors.

If the luminance uniformity is calculated, it is determined whether the calculated luminance uniformity is higher than a value (e.g., a predetermined or threshold value) (S1120). The value (or predetermined value) may be a critical value CV_LRU for determining whether the display device 100 is defective or not.

In a case where luminance uniformity is higher than the value (or the predetermined or threshold value), luminance-uniformity improvement is not required, and thus the display device can be driven without performing data scaling. However, in a case where the luminance uniformity is lower than the value (or the predetermined value), the luminance uniformity is modified to be improved, such that the driving conditions should be considered so as to increase the luminance uniformity to be higher than the value (or the predetermined or threshold value).

Subsequently, scaling ratios of the pixels are calculated or determined depending on colors (e.g., for each of the colors) based on the luminance uniformity (S1130). In order to improve luminance uniformity, a down scaling of the image data is performed and the voltage value of the driving power ELVDD is increased, and thus a scaling ratio may be determined to be less than 1. In this case, scaling ratios are adjusted for the respective pixels depending on colors (e.g., for each of the colors or for each of the different types of pixels, each type emitting a different color), such that the luminance uniformity can be adjusted.

Next, voltage values of the driving power are adjusted depending on colors (e.g., for each of the colors) based on the determined (or calculated) scaling ratios (S1140). As the scaling ratio decreases, the voltage value of the driving power may be determined (or calculated) to be higher.

Subsequently, the display device 100 is driven by the data scaling method based on the scaling ratio and the voltage value of the driving power determined in the scaling-ratio determining process (S1130) and the driving-voltage adjusting process (S1140), such that luminance uniformity can be recalculated. Accordingly, it is determined whether the recalculated luminance uniformity is higher than the value (e.g., the predetermined or threshold value).

In a case where luminance uniformity is higher than the value (or predetermined or threshold value), the display device 100 performs data scaling of the image data provided from the outside based on the scaling ratio (S1150), and expresses gray level (or gray-scale level) corresponding to the scaled image data (S1160). In other words, the display device 100 may be driven by performing data scaling based on the scaling ratios determined depending on colors (or for each of the colors) and the voltage value of the driving power.

Figure 12A:
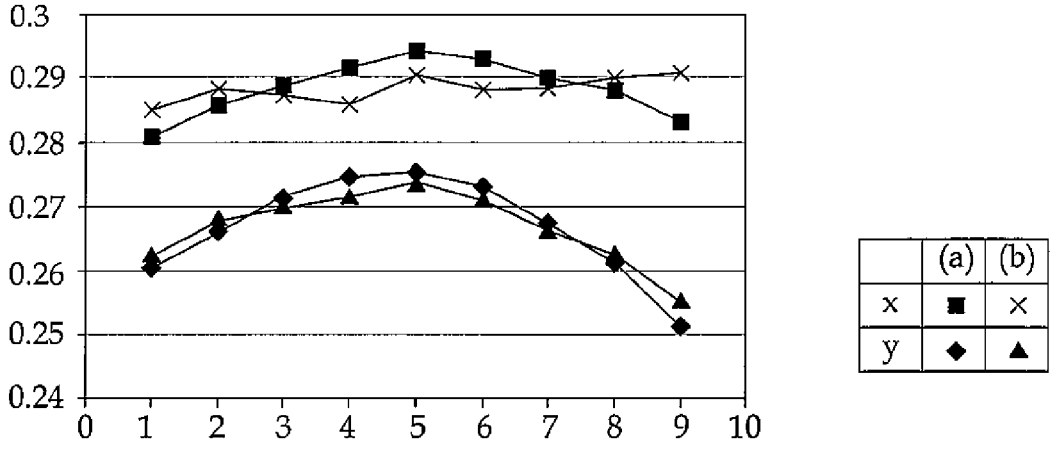
FIGS. 12A and 12B are graphs representing chromatic values of the display device according to an embodiment of the present invention.
Figure 12B:
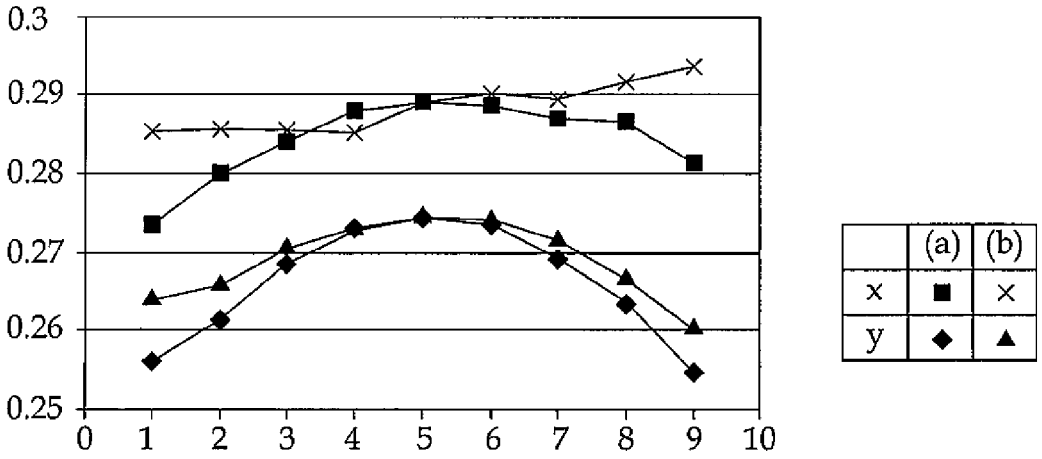

FIGS. 12A and 12B are graphs representing chromatic values of the display device according to an embodiment of the present invention. With reference to FIGS. 12A and 12B, an experiment is performed by measuring an OLED display having a separate-type panel where an upper and a bottom portions of the panel are supplied with a driving power, respectively, and thus the center portion of the panel is therefore disposed farthest from the point where the driving power is applied. Therefore, a chromatic deviation is most noticed at the center portion.

FIGS. 12A and 12B illustrate the extent of improvement in chromaticity provided that experimental conditions are established as follows: the maximum gray level (or gray-scale level) for displaying a full white color is inputted to an OLED display; and scaling ratios are respectively determined so that (a) a scaling ratio of 30% is applied to all of red, green, and blue colors (b) a scaling ratio of 30% is applied to red and green colors, and a scaling ratio of 24% is applied to a blue color.

As a result of the experiment, as shown in FIG. 12A, in case of (a), differences between the maximum value and the minimum value of the chromaticity are measured as $\Delta x=0.024$ and $\Delta y=0.0132$, respectively. Case (b) results $\Delta x=0.018$ and $\Delta y=0.0054$. As a result of the experiment shown in FIG. 12B, case (a) results $\Delta x=0.0195$ and $\Delta y=0.0155$. Case (b) results $\Delta x=0.0138$ and $\Delta y=0.0081$. Accordingly, the result shows that in the (b) condition where scaling ratios are differently applied depending on colors (or differently applied for each of the colors), the deviations of the chromatic values x and y are both reduced.

The display device according to an embodiment of the present invention may be applied to a variety of electronic products. It can, of course, be used in TV along with many different products such as a mobile phone, a monitor, a notebook computer, and a navigation system.

From the foregoing, preferred embodiments of the present invention are disclosed herein. It will be appreciated that various embodiments in accordance with the present disclosure have been described herein for purposes of illustration, and that various modifications may be made by those with ordinary skills in the pertinent art without departing from the scope and spirit of the present teachings. Accordingly, the various embodiments disclosed herein are not intended to be limiting of the true scope and spirit of the present teachings.

What is claimed is:

1. A display device comprising:

a display panel comprising a plurality of pixels;

a controller configured to scale image data provided from the outside based on a load factor of the image data, and to output the scaled image data;

a data driver configured to supply data signals corresponding to the scaled image data to a plurality of data lines connected to the pixels; and a power supply configured to generate a driving power to be supplied to the pixels to emit light, and to change a voltage value of the driving power based on the scaled image data, wherein the controller comprises:

a load factor calculator configured to calculate the load factor of the image data; and a data scaler configured to scale a gray level of the image data based on a plurality of scaling ratios corresponding to the load factor, each of the scaling ratios being determined in accordance with a corresponding one of a plurality of colors, and wherein the pixels are configured to emit light according to the scaled image data and the changed voltage value of the driving power to express the same luminance level as that of the image data prior to scaling.

2. The display device of claim 1, wherein the controller further comprises a subfield assigner configured to assign the scaled image data provided from the data scaler to subfields and to supply the subfield data to the data driver.

3. The display device of claim 2, wherein the subfield assigner is configured to divide a frame into a plurality of subfields having different emission periods.

4. The display device of claim 2, wherein the subfields include scan periods.

5. The display device of claim 1, wherein the data scaler includes a red data scaler, a green data scaler, and a blue data scaler.

6. The display device of claim 1, wherein at least one of the scaling ratios corresponding to one of the colors has a lower value compared to the scaling ratios corresponding to the other colors.

7. The display device of claim 6, wherein at least one of the scaling ratios is less than 1.

8. The display device of claim 6, wherein a blue scaling ratio is the lowest of the scaling ratios.

9. The display device of claim 6 wherein the power supply is configured to change the voltage value of the driving power supplied to the pixels in accordance with the colors of the corresponding pixels based on the scaled image data.

10. The display device of claim 9, wherein the power supply is configured to increase the voltage value of the driving power when the scaling ratio is less than 1.

11. The display device of claim 9, wherein the power supply is configured to increase the voltage value of the driving power in accordance with a decrease in the scaling ratio.

12. A display device comprising:

an organic light emitting display panel comprising a plurality of pixels, the plurality of pixels comprising a first pixel, a second pixel, and a third pixel configured to emit light having a plurality of different colors, and a plurality of data lines and a plurality of scan lines connected to the plurality of pixels;

a scan driver configured to sequentially supply a plurality of scan signals to the scan lines during respective scan periods of a plurality of subfields of one frame;

a load factor calculator configured to calculate a plurality of load factors of image data provided from the outside;

first, second, and third data scalers configured to scale data values of the image data in accordance with scaling ratios of first, second, and third colors of the different colors, the scaling ratios corresponding to the load factors;

a data driver configured to supply data signals generated based on the scaled image data to the data lines; and a power supply configured to generate a first driving power, a second driving power, and a third driving power supplied to corresponding ones of the first pixel, the second pixel, and the third pixel, and to adjust at least one of voltage values of the first driving power, the second driving power, and the third driving power, wherein the pixels are configured to emit light according to the scaled data values and corresponding ones of the adjusted voltage values of the first, second, and third driving powers to express the same luminance level as that of the image data prior to scaling.

13. The display device of claim 12 further comprising a subfield assigner configured to assign the scaled image data provided from the first, second, and third data scalers as subfield data to subfields and to supply the subfield data to the data driver.

14. The display device of claim 13, wherein at least one of the scaling ratios of the first, second, and third colors has a lower value than the scaling ratios of the other colors.

15. The display device of claim 12, wherein the power supply is configured to increase the voltage values of the driving power in accordance with decreases in the scaling ratios.

16. The display device of claim 12, wherein the first pixel is a red pixel, the second pixel is a green pixel, and the third pixel is a blue pixel.

17. A method of driving a display device, the method comprising:

calculating a load factor of image data provided from the outside;

determining a plurality of scaling ratios corresponding to the load factor, each of the scaling ratios being determined in accordance with a corresponding one of a plurality of colors;

scaling a plurality of data values of the image data in accordance with the scaling ratios;

adjusting a plurality of voltage values of a driving power corresponding to each of the colors based on the scaling ratios corresponding to each of the colors; and expressing, by the pixels, a gray level corresponding to the scaled image data, the scaled image data being scaled in accordance with the colors of the pixels, wherein the pixels emit light according to the scaled image data and the adjusted voltage values of the driving power to express the same luminance level as that of the image data prior to scaling.

18. The method of claim 17, wherein at least one of the scaling ratios has a lower value than the other scaling ratios.

19. The method of claim 18, wherein the adjusting the voltage values comprises increasing the voltage value of the driving power in accordance with a decrease of the scaling ratio.

20. The method of claim 18, wherein a blue scaling ratio is the lowest of the plurality of the scaling ratios.

* * * * *